US006066815A

United States Patent [19]

Spedale

[11] Patent Number: 6,066,815

[45] Date of Patent: May 23, 2000

[54] ELECTRICAL CONNECTOR-POWER SWITCH MODULE

[75] Inventor: Joseph J. Spedale, Chicago, Ill.

[73] Assignee: Illinois Tool Works Inc., Glenview, Ill.

[21] Appl. No.: 09/138,912

[22] Filed: Aug. 24, 1998

[51] Int. Cl.[7] ..... H01H 9/00; H01H 1/58; H01H 21/24

[52] U.S. Cl. ..... 200/51.03; 200/284; 200/293; 200/339; 200/553

[58] Field of Search ..... 200/5 R, 5 A, 200/51 R–51.11, 553, 284, 293, 297, 329, 339; 439/185, 395, 402, 404

[56] References Cited

U.S. PATENT DOCUMENTS

| | | | |
|---|---|---|---|
| 3,209,091 | 9/1965 | Freathy et al. | 200/51 |
| 3,324,260 | 6/1967 | Schumacher | 200/51 |
| 3,493,916 | 2/1970 | Hansen | 339/17 |
| 3,670,121 | 6/1972 | Howe | 200/67 G |
| 3,671,693 | 6/1972 | Farrell | 200/67 G |
| 3,673,368 | 6/1972 | Howe et al. | 200/67 G |
| 3,749,872 | 7/1973 | Foster | 200/166 PC |
| 3,879,592 | 4/1975 | Comerford et al. | 200/153 G |
| 4,103,125 | 7/1978 | Marrero | 200/51 R |
| 4,272,662 | 6/1981 | Simpson | 200/275 |
| 4,383,155 | 5/1983 | Tenner | 200/315 |
| 4,410,230 | 10/1983 | San Miguel | 339/126 M |
| 4,447,689 | 5/1984 | Schiller | 200/330 |
| 4,525,253 | 6/1985 | Sorenson | 200/68.2 |
| 4,869,677 | 9/1989 | Johnson et al. | 439/80 |
| 4,982,061 | 1/1991 | Dignal | 200/302.3 |
| 5,171,161 | 12/1992 | Kachlic | 439/352 |
| 5,173,056 | 12/1992 | Kniese et al. | 439/79 |
| 5,199,886 | 4/1993 | Patterson | 439/79 |
| 5,236,375 | 8/1993 | Kachlic | 439/607 |
| 5,252,080 | 10/1993 | Pesson | 439/79 |
| 5,293,018 | 3/1994 | Lander | 200/557 |
| 5,364,280 | 11/1994 | Colleran | 439/76 |
| 5,366,381 | 11/1994 | Kile | 439/79 |
| 5,452,175 | 9/1995 | Tsai | 361/643 |
| 5,453,016 | 9/1995 | Clark et al. | 439/79 |
| 5,482,470 | 1/1996 | Atsumi et al. | 439/246 |
| 5,490,787 | 2/1996 | Bowman et al. | 439/79 |
| 5,507,659 | 4/1996 | Sumida et al. | 439/157 |
| 5,511,984 | 4/1996 | Olson et al. | 439/79 |
| 5,518,422 | 5/1996 | Zell et al. | 439/608 |
| 5,564,948 | 10/1996 | Harting et al. | 439/607 |
| 5,584,709 | 12/1996 | Kiat | 439/79 |
| 5,591,035 | 1/1997 | Burkholder et al. | 439/79 |
| 5,591,036 | 1/1997 | Doi et al. | 439/79 |
| 5,593,307 | 1/1997 | Bale et al. | 439/79 |
| 5,601,183 | 2/1997 | Boyd et al. | 200/553 |
| 5,616,035 | 4/1997 | Shu | 439/79 |
| 5,639,250 | 6/1997 | Neef et al. | 439/79 |
| 5,651,685 | 7/1997 | Brinkman et al. | 439/79 |
| 5,658,155 | 8/1997 | McFarlane et al. | 439/79 |
| 5,658,156 | 8/1997 | Henderson et al. | 439/79 |
| 5,659,209 | 8/1997 | Huen | 307/125 |
| 5,676,554 | 10/1997 | Tsuji | 439/79 |
| 5,679,009 | 10/1997 | Okumura et al. | 439/79 |
| 5,688,130 | 11/1997 | Huang | 439/79 |
| 5,692,912 | 12/1997 | Nelson et al. | 439/79 |
| 5,702,257 | 12/1997 | Millhimes | 439/79 |
| 5,743,765 | 4/1998 | Andrews et al. | 439/608 |
| 5,807,124 | 9/1998 | Bricaud et al. | 439/188 |
| 5,819,912 | 10/1998 | Hou | 200/51.02 |
| 5,857,870 | 1/1999 | Carter | 439/402 |

*Primary Examiner*—Michael Friedhofer
*Attorney, Agent, or Firm*—Schwartz & Weinrieb

[57] ABSTRACT

A combination, one-piece, integral, electrical connector and rocker-type power switch module comprises an electrical connector housing having a plurality of 90° terminals mounted therein and adapted to be mounted upon and connected to a printed circuit board (PCB), and a power switch housing having a rocker mechanism, a substantially U-shaped, hairpin type contactor, and a pair of contacts defining a common contact and a make/break contact. The housings are fabricated from a thermoplastic material and are specially structured so as to permit the mounting of the power switch housing upon the electrical connector housing whereby the housings may be ultrasonically welded together so as to form the one-piece, integral module.

25 Claims, 5 Drawing Sheets

ELECTRICAL CONNECTOR-POWER SWITCH MODULE

FIELD OF THE INVENTION

The present invention relates generally to electrical connectors and power switches, and more particularly to a combination, one-piece integral electrical connector and rocker type power switch module which is particularly intended for use in connection with and mounting upon a printed circuit board (PCB).

BACKGROUND OF THE INVENTION

Rocker type switches, comprising for example, a rocker element operatively connected to a substantially U-shaped contactor having a hairpin configuration, are of course well known in the art and are exemplified by means of the rocker switches disclosed within U.S. Pat. Nos. 5,293,018, 4,982,061, 4,272,662, 3,879,592, 3,749,872, and 3,670,121. In a similar manner, electrical connectors having a vertical and horizontal array of 90° angled terminals and adapted to be connected to and mounted upon a printed circuit board (PCB) are likewise well known in the art and are exemplified by means of U.S. Pat. Nos. 5,676,554, 5,639,250, 5,482,470, 5,366,381, 5,236,375, 5,173,161, and 3,493,916.

It is also desirable in the art of fabricating printed circuit boards and the circuits disposed thereon to operatively associate or connect a suitable switch mechanism to the various electrical connectors mounted upon the printed circuit board in order to control electrical power to the various circuits of the printed circuit board. However, the operative association of such a power switch with the electrical connectors and printed circuits of the pointed circuit board has heretofore or conventionally only been achieved through the provision of, for example, the particular electrical connector, which is mounted upon the printed circuit board, and the electrical switch, as two separate elements, devices, units, or entities. More particularly, the electrical switch is usually mounted upon a suitable bracket and then operatively connected, by suitable electrical wiring, to the electrical connector which, in turn, is electrically connected to the printed circuits of the printed circuit board (PCB) as a result of the electrical connector being mounted upon the printed circuit board whereby end portions of the terminals of the electrical connector are electrically engaged with or connected to the printed circuits of the printed circuit board.

The provision of electrical power switches and electrical connectors, operatively associated with, for example, printed circuit boards (PCBs), as separate or discrete entities, elements, or devices however, is simply not economical or cost-efficient from a manufacturing and/or assembly point of view for several reasons. Firstly, the electrical connectors and the power switches must be separately manufactured. Secondly, the electrical connectors and power switches must be separately inventoried and distributed to suppliers and end users, that is, manufacturers, for example, who will use such elements or devices in connection with the manufacture of various electrical systems or components. Thirdly, when such end user manufacturers incorporate such electrical connector and power switch elements within the manufactured systems or components, the connectors and switches must be separately mounted upon their respective support members and then electrically connected together. All of these assembly operations are necessarily labor-intensive and time-consuming.

A need therefore exists in the art for a combination, one-piece integral electrical connector and rocker type power switch module wherein the manufacturing process or operation for such a module is substantially simplified relative to the manufacture of the electrical connectors and power switches as separate elements or devices, wherein the inventory and supply of such connector and switch modules or parts is likewise simplified and more cost-efficient, and wherein the manufacture of electrical systems and components employing such electrical connector and power switch elements, devices, or modules is necessarily simplified and more cost-effective.

OBJECTS OF THE INVENTION

Accordingly, it is an object of the present invention to provide a new and improved combination, one-piece integral electrical connector and rocker-type power switch module which is especially adapted for use and mounting upon a printed circuit board (PCB) in order to control electrical power to the various circuits of the printed circuit board (PCB).

It is another object of the present invention to provide a new and improved combination, one-piece integral electrical connector and rocker-type power switch module which is especially adapted for use and mounting upon a printed circuit board (PCB) in order to control electrical power to the various circuits of the printed circuit board (PCB) and which overcomes the various drawbacks of conventional or prior art systems employing separate electrical connectors and power switch devices.

It is a further object of the present invention to provide a new and improved combination, one-piece integral electrical connector and rocker-type power switch module which is especially adapted for use and mounting upon a printed circuit board (PCB) in order to control electrical power to the various circuits of the printed circuit board (PCB) and which enables relatively simplified and cost-effective manufacture, inventory, supply, and distribution of such printed circuit board electrical connectors and power switch devices by the electrical connector-power switch module manufacturers, as well as the relatively simplified and cost-effective inventory and supply of such printed circuit board electrical connector-power switch modules by manufacturers of various electrical systems or components utilizing such printed circuit boards and the electrical connectors and power switches therefor.

SUMMARY OF THE INVENTION

The foregoing and other objects are achieved in accordance with the teachings of the present invention through the provision of a new and improved combination, one-piece integral electrical connector and rocker-type power switch module wherein a rocker-type power switch housing is specifically structured or adapted to be mounted upon a printed circuit board (PCB) electrical connector having 90° angled terminals disposed therein and having detent means operatively associated therewith for mounting the connector upon the printed circuit board (PCB). In particular, the switch housing and electrical connector are provided with complementary latching structure which permit the two components to be mated together at a specific position with respect to each other whereupon the two components can be subsequently integrally fixed to each other by suitable means, such as, for example, by ultrasonic welding, so as to form the combination, one-piece, integral electrical connector-power switch module.

As a result of the fabrication or manufacture of such a combination, one-piece, integral electrical connector-power switch module, the need for separate manufacture, inventory, supply, and distribution of the particular electrical connectors and power switch devices is effectively eliminated, and such components are now able to be manufactured as a single unit, entity, or module in a relatively simplified and cost-effective manner. In addition, the inventory, supply, and distribution of such components is substantially simplified, as is the inventory and supply of such components by manufacturers of systems and components utilizing, for example, printed circuit boards and the electrical connectors and power switches therefor.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
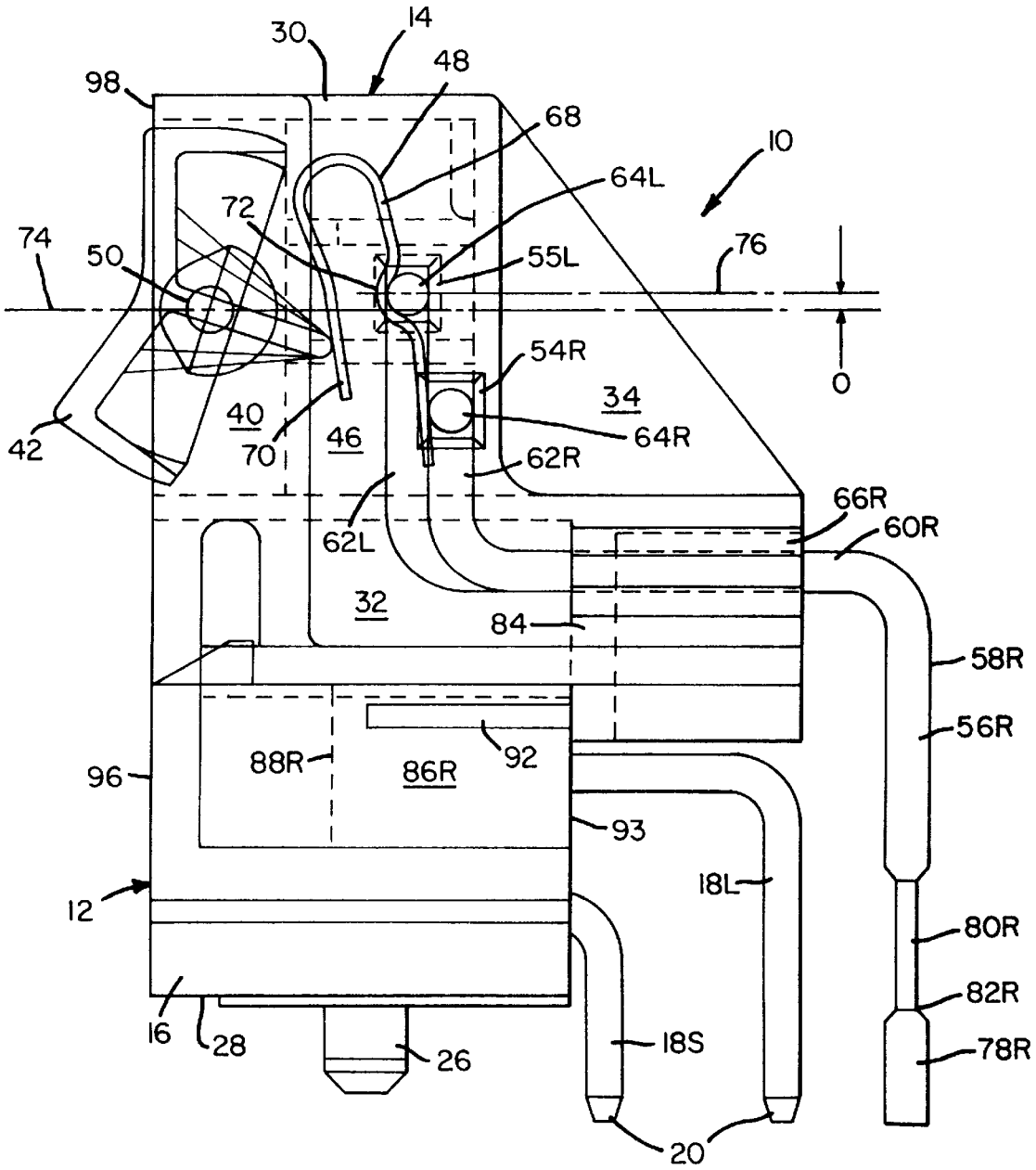
FIG. 1 is a schematic, right-side elevation view of the new and improved combination, one-piece, integral electrical connector and rocker-type power switch module fabricated in accordance with the teachings of the present invention and showing the primary component parts thereof when the power switch is disposed in the ON position or state.
Figure 11:
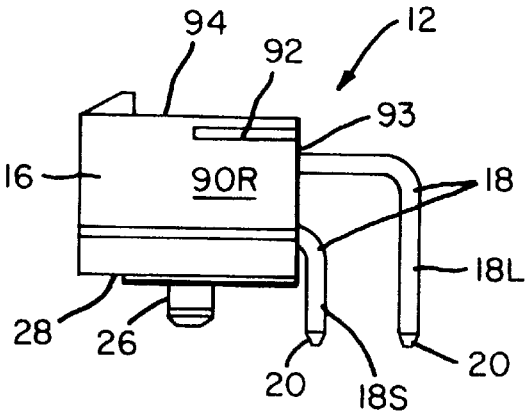
FIG. 11 is a right-side elevational view of the printed circuit board electrical connector.
Figure 12:
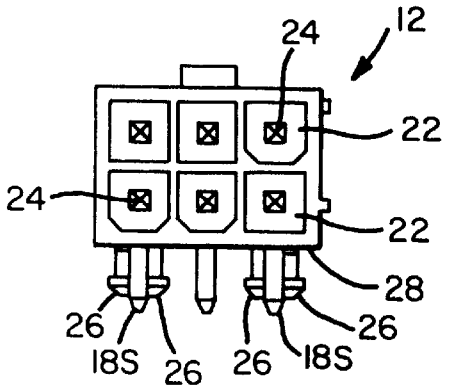
FIG. 12 is a rear elevational view of the electrical connector as shown in FIG. 11.

Referring now to the drawings, and more particularly to FIG. 1 thereof, the new and improved combination, one-piece, integral electrical connector and rocker-type power switch module constructed in accordance with the teachings of the present invention is generally indicated by the reference character 10 and is seen to comprise an electrical connector 12 and a power switch housing 14. With additional reference being made to FIGS. 11 and 12, the electrical connector 12 is seen to comprise a housing 16 which has the general configuration of a rectangular parallelepiped within which a plurality of 90° or substantially L-shaped terminal members 18 are fixedly disposed.

In particular, the electrical connector 12 is provided with six terminal members 18, and the terminal members 18 comprise two sets of terminal members 18 wherein a first one of the two sets of terminal members 18 comprises three relatively long terminal members 18L, while a second one of the two sets of terminal members 18 comprises three relatively short terminal members 18S. The terminal ends 20 of all of the short legs of all of the substantially L-shaped terminal members 18 depend vertically downwardly and are disposed externally of the electrical connector housing 16 so as to be inserted into suitable apertures, not shown, formed within, for example, a printed circuit board (PCE), also not shown, upon which the electrical connector 12 is adapted to be mounted. The rear portion of the electrical connector housing 16 is provided with an array of substantially square-shaped apertures or cells 22 within which opposite horizontally oriented terminal ends 24 of the terminal members 18 are internally disposed. As can therefore be appreciated, the terminal ends 20 and 24 are disposed within an array which comprises two rows with three terminal ends disposed within each row. In order to fixedly mount the electrical connector 12 upon the printed circuit board (PCB), not shown, a pair of snap-fitting detent members 26, which are adapted to be snap-fittingly inserted into suitable apertures, not shown, formed within the printed circuit board (PCB), also not shown, are provided upon the bottom surface or underside portion 28 of the electrical connector housing 16 at positions adjacent each lateral side of the connector housing 16.

Figure 2:
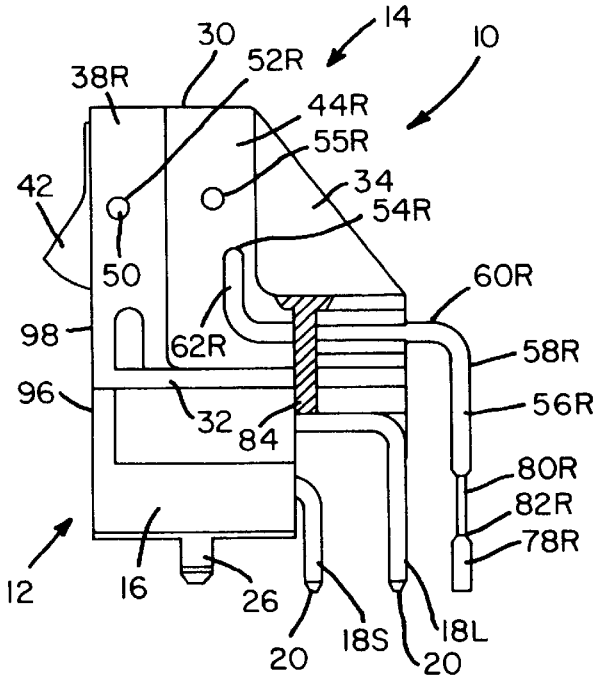
FIG. 2 is a view similar to that of FIG. 1 in that the same shows the combination, ore-piece, integral electrical connector and rocker-type power switch module wherein, however, some of the internal parts of the power switch housing are shown in cross-section.
Figure 3:
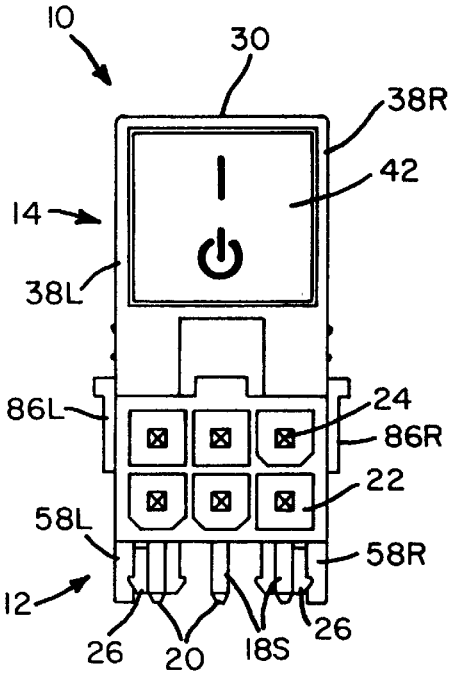
FIG. 3 is a rear elevation view of the electrical connector-power switch module shown in FIG. 2.
Figure 4:
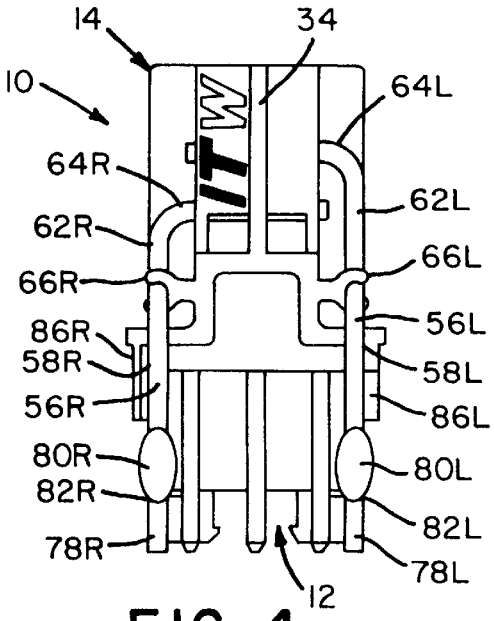
FIG. 4 is a front elevation view of the electrical connector-power switch module shown in FIG. 2.
Figure 5:
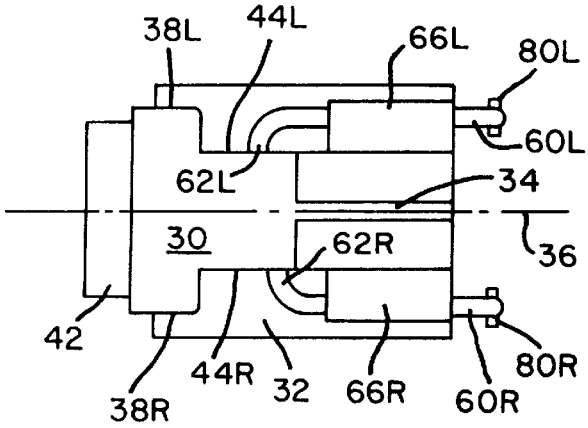
FIG. 5 is a top plan view of the electrical connector-power switch module shown in FIG. 2.
Figure 6:
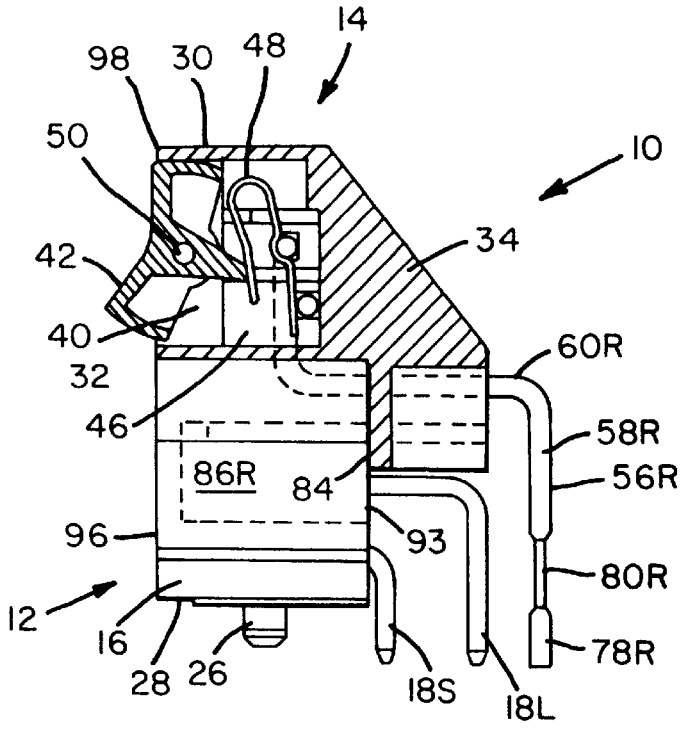
FIG. 6 is a view similar to those of FIGS. 1 and 2 wherein, however, additional internal parts of the power switch housing are shown in cross-section and disclosed in detail.
Figure 7:
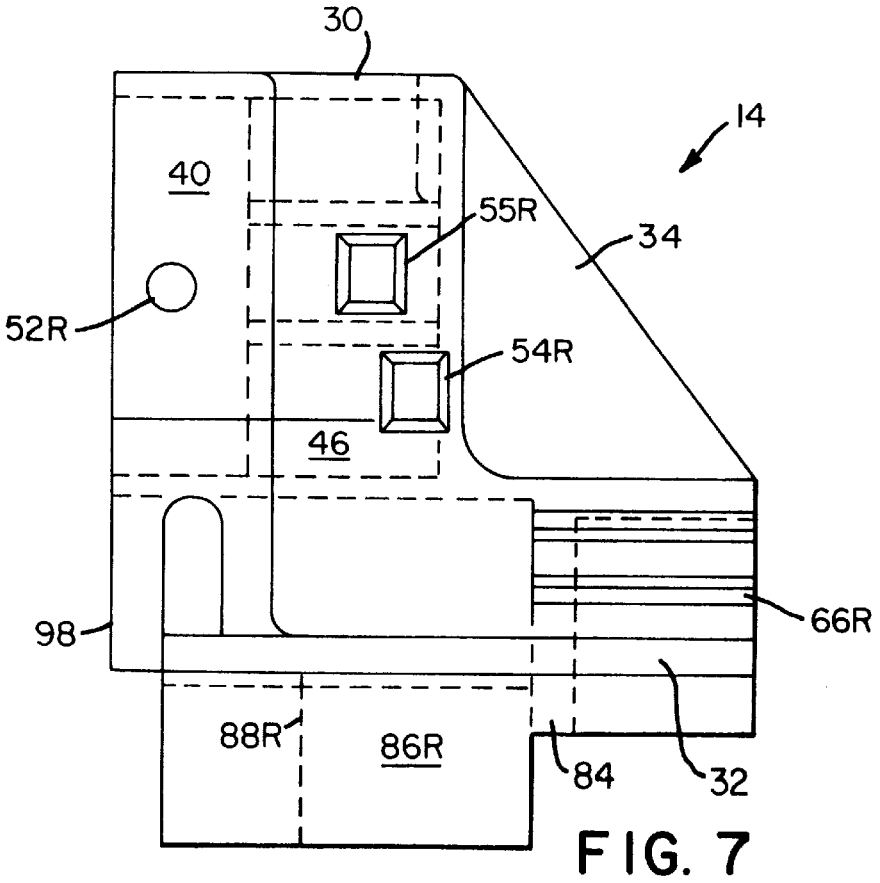
FIG. 7 is a right-side elevational view of the rocker-switch housing with the rocker, contactor, and wireform contacts removed.
Figure 8:
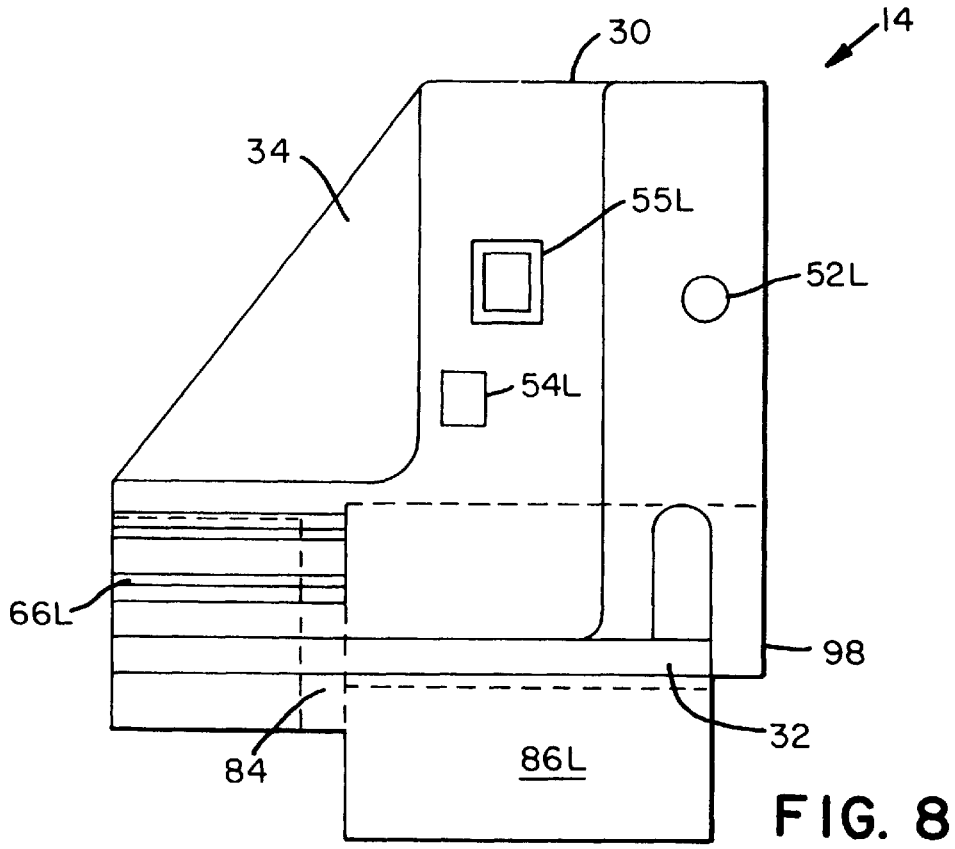
FIG. 8 is a left-side elevational view of the rocker-switch housing as shown in FIG. 7.
Figure 9:
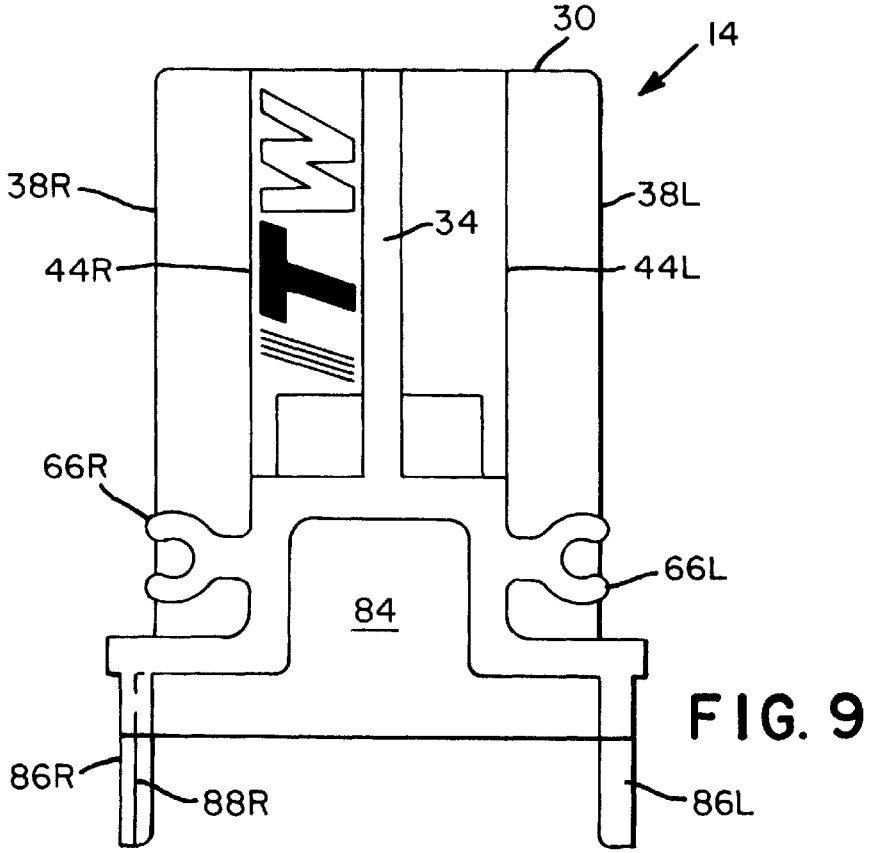
FIG. 9 is a front elevational view of the rocker-switch housing as shown in FIGS. 7 and 8.
Figure 10:
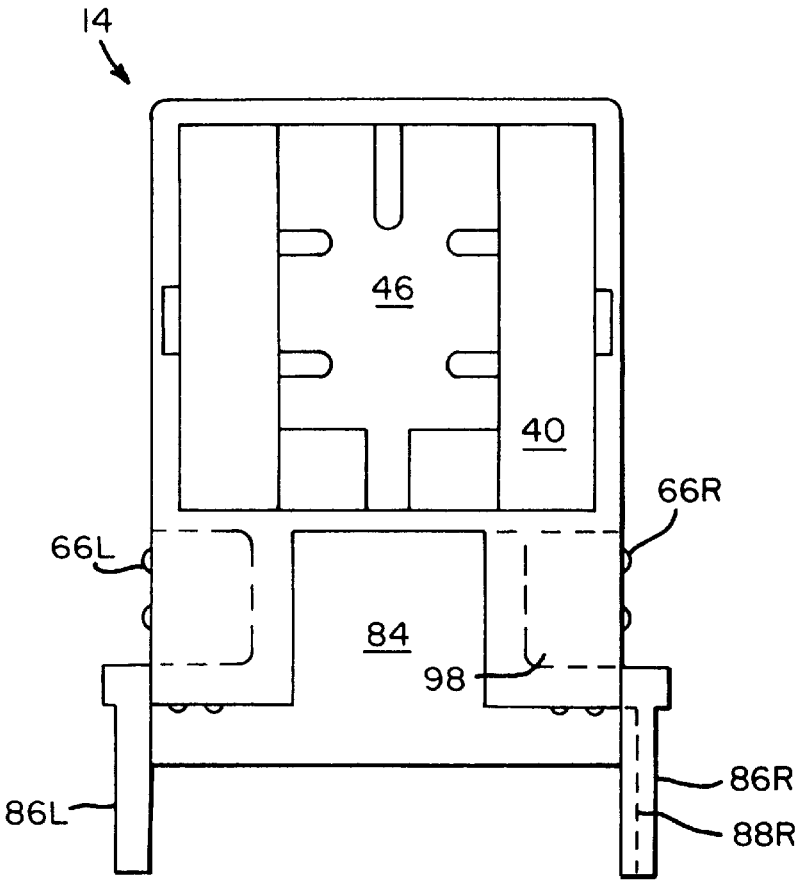
FIG. 10 is a rear elevational view of the rocker-switch housing as shown in FIGS. 7–9.

With continued reference being made to FIG. 1, and with additional reference being made to FIGS. 2–10, the power switch housing 14 is seen to have a substantially L-shaped configuration comprising a vertically upstanding section 30 and a horizontally extending section 32, with a substantially triangularly configured rib member 34 interconnecting the upstanding and horizontal sections 30 and 32 along a centerline 36 of the housing 14 as best seen in FIG. 5. As is also best appreciated from FIG. 5, the upstanding section 30 of the switch housing 14 is seen to have a substantially T-shaped cross-sectional configuration, wherein a first set of laterally spaced sidewalls 38R and 38L define a first internal chamber 40, as best seen in FIG. 1, within which a switch rocker 42 is pivotally disposed, and a second set of laterally spaced sidewalls 44R and 44L define a second internal chamber 46 within which a substantially U-shaped or hair-pin type contactor 48 is pivotally disposed. The switch rocker 42 is provided with a pair of co-axially disposed trunnions 50, only one of which is visible in FIGS. 1 and 6, and the upstanding sidewalls 38R and 38L are provided with suitable coaxially disposed apertures 52R and 52L, as best seen in FIGS. 2, 7, and 8, within which the trunnions 50 are disposed so as to provide the pivotal movement for the rocker 42.

As best seen from FIGS. 1, 2, 7, and 8, each one of the upstanding sidewalls 44R and 44L of the switch housing 14 are also provided with a pair of suitable vertically and horizontally offset apertures 54R,55R and 54L,55L for respectively accommodating contact portions of right and left wireform contact members 56R and 56L. The wireform contact members 56R and 56L are substantially identical mirror-images of each other, with one exception as will be noted shortly hereafter, and as can be appreciated from FIGS. 1, 2, and 4–6, the wireform contact members 56R and 56L respectively comprise a first vertically extending portion 58R,58L, a first horizontally extending portion 60R, 60L, and a second vertically extending portion 62R, 62L, with the vertical and horizontal portions 58R,60R, and 62R of the wireform contact member 56R being disposed in a coplanar manner with respect to each other, as are the vertical and horizontal portions 58L,60L, and 62L of the wireform contact member 56L. The wireform contact members 56R and 56L also respectively comprise a second horizontally extending portion 64R and 64L, and it is seen that such second horizontally extending portions 64R and 64L extend transversely with respect to the centerline 36 of the switch housing 14 and perpendicular to the plane within which the wireform portions 58R,60R, and 62R, and 58L, 60L, and 62L, are respectively disposed.

More particularly, wireform contact portion 64R enters the switch housing 14 through means of aperture 54R, and the terminal end of wireform contact portion 64R exits switch housing 14 through means of aperture 54L. In a similar manner, wireform contact portion 64L enters the switch housing 14 through means of aperture 55L and the terminal end of wireform contact portion 64L exits switch housing 14 through means of aperture 55R. In order to position the various portions of the wireform contacts 56R and 56L at the noted locations with respect to the switch housing 14, it is noted that the vertical length or extent of second vertically extending portion 62L of wireform contact member 56L is somewhat greater than the corresponding vertical length or extent of second vertically extending portion 62R of wireform contact member 56R which, as noted above, constitutes the only significant difference between the wireform contact members 56R,56L.

In order to further fix the wireform contact members 56R,56L upon the switch housing 14, opposite sides of the horizontally extending section 32 of switch housing 14 are respectively provided with resilient or flexible detent clamp members 66R,66L, having a substantially C-shaped configuration, within which the first horizontally extending portions 60R,60L of the wireform contact members 56R,56L are snap-fittingly engaged. When the wireform contact members 56R,56L are thus fixedly mounted within the power switch housing 14, the second horizontally extending portion 64R of the wireform contact member 56R serves as a make/break contact member, while the second horizontally extending portion 64L of the wireform contact member 56L serves as a common contact member.

As illustrated in FIGS. 1 and 6, the substantially U-shaped hairpin type contactor 48 is provided with a relatively long leg 68 and a relatively short leg 70, and a concave or recessed portion 72 is defined within the longer one 68 of the two leg portions 68,70 of the contactor 48. This concave or recessed portion 72 is mounted upon the common contact member 64L so as to be pivotal with respect thereto when the rocker member 42 acts upon the shorter leg 70 of the contactor 48. In particular, the rocker member 42 causes the longer leg 68 of the contactor 48 to be engaged with the make/break contact 64R when the rocker member 42 is disposed in its illustrated position whereby the switch is disposed in its ON state, and causes the longer leg 68 of the contactor 48 to be disengaged from the make/break contact 64R when the rocker member 42 is disposed in its alternative pivotal state, not shown, whereby the switch is disposed in a STANDBY state. It is further noted that rocker member 42 is pivotal about the axes of trunnions 50 which are disposed within a plane 74, while the pivotal axis of the contactor 48, as determined by the axis of the common contact 64L, is disposed within a plane 76 whereby the two planes 74 and 76 are offset with respect to each other by means of a distance O. In this manner, the force distribution from the rocker member 42, and therefore the forces acting upon the contactor 48 are such as to, in effect, bias the contactor 48 toward the engaged position with the make/break contact 64R whereby, further, the circuits provided upon the printed circuit board (PCB), not shown, being controlled by means of the power switch assembly provided within the power switch housing 14 are maintained in their ON state and are prevented from being inadvertently deprived of power unless the rocker member 42 is intentionally moved to its alternative state or position.

When the combination electrical connector-power switch module 10 is to be mounted upon the printed circuit board (PCB), not shown, in order to provide and control electrical power to the various circuits of the printed circuit board (PCB), not shown, the lower ends of the wireform contact portions 58R,58L, in a manner similar to the terminal ends 20 of the electrical connector terminals 18, are also provided with terminal ends 78R,78L which are adapted to be inserted through suitable apertures provided within the printed circuit board (PCB), not shown. In order to predetermine the depth to which the terminal ends 78R,78L of the wireform contact portions 58R,58L are to be inserted into and through the apertures provided within the printed circuit board (PCB), not shown, lower regions of the wireform contact portions 58R,58L are respectively provided with crimped or flattened sections 80R,80L whereby lower ends 82R,82L of such flattened or crimped sections 80R,80L will engage the upper surface of the printed circuit board (PCB), not shown, so as to prevent further insertion of the wireform contact terminal ends 78R,78L into the apertures defined within the printed circuit board (PCB), not shown.

In order to be able to mount the combination, one-piece, integral electrical connector-power switch module 10 upon, for example, a printed circuit board (PCB), not shown, as a single unit or entity, the electrical connector 12 and the power switch housing 14 components must of course be fixed or mated together during the manufacture of the module 10 as a one-piece or single unit or entity. Accordingly, with further reference being particularly made to FIGS. 1–3, and 6–12, the horizontally extending section 32 of the power switch housing 14 includes a vertically dependent wall or barrier 84 which is disposed transversely with respect to the centerline 36 of the switch housing 14. In addition, a pair of dependent sidewalls or skirt portions 86R,86L extend downwardly from horizontally extending section 32 of the power switch housing 14 so as to be disposed parallel to the centerline 36 of the switch housing 14. The rear section of the right sidewall or skirt portion 86R has a thickness dimension which is substantially twice the thickness dimension of the forward section of the right sidewall or skirt portion 86R whereby a vertically extending ridge or shoulder portion 88R is defined at the intersection of such rear and forward sections of the right sidewall or skirt portion 86R and upon the internal side or surface thereof.

The right sidewall 90R of the electrical connector housing 16 is provided with a horizontally extending rib 92 within an upper region of the right sidewall 90R, and it is seen that the right end of the rib member 92 terminates at the front wall 93 of the electrical connector housing 16. As can best be appreciated from FIG. 1, the axial or longitudinal length of the rib 92 of the electrical connector housing 16, as measured from the front wall 93 of the electrical connector housing 16 to the opposite or free end of the rib member 92, is somewhat less than the distance defined between the vertically dependent wall or barrier 84 and the vertically extending ridge or shoulder portion 88R of the power switch housing 14.

Consequently, when it is desired to mate the power switch housing 14 and the electrical connector 12, the electrical connector housing 16 is inserted in a vertically upward direction between the dependent skirt or sidewall portions 86R,86L of the power switch housing 14 until the top surface 94 of the electrical connector housing 16 abuts the undersurface of the horizontally extending section 32 of the power switch housing 14. The rib member 92 of the electrical connector housing 16 will be accommodated between the plane of the vertically dependent wall or barrier 84 and the vertically extending ridge or shoulder portion 88R of the power switch housing 14, and once the top surface 94 of the electrical connector housing 16 is engaged or in abutment with the undersurface of the horizontally extending section 32 of the power switch housing 14, only a limited amount of "play" of the electrical connector housing 16 is permitted in the horizontal direction with respect to the power switch housing 14. More particularly, substantial horizontal movement of the electrical connector housing 16 relative to the power switch housing 14 is prevented as a result of the front wall 93 of the electrical connector housing 16 encountering the wall or barrier 84 of the power switch housing 14, and the left end of the rib member 92 encountering the vertical ridge or shoulder portion 88R of the power switch housing.

The preferred position of the electrical connector housing 16 with respect to the power switch housing 14 is the one at which the front wall 93 of the electrical connector housing 16 is in abutment with the vertically dependent wall or barrier 84 of the power switch housing 14 as shown in FIG. 1. In this position, it is seen that the rear wall 96 of the electrical connector housing 16 is in alignment with the rear wall 98 of the power switch housing 14. The electrical connector housing 16 and the power switch housing 14 are fabricated from suitable thermoplastic materials and may consequently be fixed together by suitable means, such as, for example, ultrasonic welding, or the like, whereby the combination, one-piece, integral electrical connector-power switch module 10 is achieved.

Thus, it may be seen that in accordance with the teachings of the present invention, a new and improved combination, one-piece, integral electrical connector and rocker type power switch module has been developed wherein the manufacturing, inventory, and supply of such modules is substantially simplified and more cost-effective as opposed to the manufacture, inventory, and supply of separate electrical connectors and power switch devices, and similarly for the manufacture of electrical systems and components employing such electrical connector and power switch modules.

Obviously, many modifications and variations of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A combination electrical connector-power switch module, comprising:

an electrical connector comprising a housing having a plurality of electrical terminals mounted within said housing for connection to electrical circuits;

a power switch comprising a housing having a plurality of electrical terminals, a switch mechanism mounted therein for controlling electrical power to said plurality of electrical terminals of said electrical connector through the electrical circuits, and a recess defined within a lower portion of said power switch housing for accommodating an upper portion of said electrical connector housing; and means for integrally connecting said lower portion of said power switch housing to said upper portion of said electrical connector housing such that said power switch is integrally mounted upon said electrical connector, whereby a combination, one-piece, integral electrical connector-power switch module is formed.

2. The module as set forth in claim 1, wherein:

said plurality of electrical terminals of said electrical connector comprise terminals bent at a 90° angle wherein one end of each one of said plurality of electrical terminals of said electrical connector is insertable through an aperture defined within a printed circuit board (PCB) having electrical circuits defined thereon.

3. The module as set forth in claim 2, wherein:

said plurality of electrical terminals of said power switch housing comprise terminals bent at a 90° angle wherein one end of each one of said plurality of electrical terminals of said power switch housing is insertable through an aperture defined within the printed circuit board (PCB) having the electrical circuits defined thereon so as to provide electrical power to the electrical circuits of the printed circuit board (PCB) and said plurality of electrical terminals of said electrical connector.

4. The module as set forth in claim 3, wherein:

each one of said plurality of electrical terminals of said power switch housing have crimped, flattened portions defined adjacent to said one end of said each one of said plurality of electrical terminals so as to limit the depth to which said one end of said each one of said plurality of electrical terminals of said power switch housing can be inserted into the apertures of the printed circuit board (PCB).

5. The module as set forth in claim 3, wherein:

a second end of a first one of said plurality of electrical terminals of said power switch housing defines a common electrical contact, a second end of a second one of said plurality of electrical terminals of said power switch housing defines a make/break contact; and said switch mechanism comprises a contactor having a first portion always in contact with said common electrical contact, and a second portion movable between a first position at which said second portion is engaged with said make/break contact so as to define an ON state for said power switch, and a second position at which said second portion is disengaged from said make/break contact so as to define a STANDBY state for said power switch; and an actuator for moving said contactor between said first and second positions.

6. The module as set forth in claim 5, wherein:

said contactor comprises a substantially U-shaped hairpin type contactor comprising first and second leg members.

7. The module as set forth in claim 6, wherein:

said first leg member of said contactor has said first portion of said contactor defined therein as a recessed portion disposed around said common electrical contact so as to define therewith a first pivotal axis around which said contactor is pivotally movable between said first and second positions; and said actuator comprises a rocker-type actuator pivotally movable around a second pivotal axis for movement between first and second positions and engaged with said second leg member of said contactor for movably actuating said contactor between said first and second positions of said contactor when said actuator is moved between said first and second positions of said actuator.

8. The module as set forth in claim 7, wherein:

said first and second pivotal axes of said contactor and said rocker-type actuator are offset with respect to each other so as to bias said contactor toward said ON state.

9. The module as set forth in claim 5, wherein:

said power switch housing comprises substantially C-shaped clamping members for clampingly engaging portions of said plurality of electrical terminals of said power switch housing intermediate said first and second ends of said electrical terminals of said power switch housing.

10. The module as set forth in claim 5, wherein:

said power switch housing comprises a pair of oppositely disposed sidewalls having a pair of apertures defined within each one of said pair of oppositely disposed sidewalls wherein each one of said pair of apertures defined within one of said pair of oppositely disposed sidewalls is coaxially aligned with one of said pair of apertures defined within the other one of said pair of oppositely disposed sidewalls; and said common electrical contact and said make/break contact extend transversely across said power switch housing between said pair of oppositely disposed sidewalls wherein said second end of said first one of said plurality of electrical terminals defining said common electrical contact enters a first one of said apertures defined within a first one of said pair of oppositely disposed sidewalls and exits through a first one of said apertures, coaxially aligned with said first one of said apertures, defined within a second one of said pair of oppositely disposed sidewalls, and said second end of said second one of said plurality of electrical terminals defining said make/break contact enters a second one of said apertures defined within said second one of said pair of oppositely disposed sidewalls and exits through a second one of said apertures, coaxially aligned with said second one of said apertures, defined within said first one of said pair of oppositely disposed sidewalls.

11. The module as set forth in claim 2, wherein:

said electrical connector housing comprises detent means for snap-fitting engagement within apertures defined within the printed circuit board (PCB) so as to fixedly mount said electrical connector upon the printed circuit board (PCB).

12. The module as set forth in claim 1, wherein:

said power switch housing and said electrical connector housing are fabricated from a thermoplastic material and are ultrasonically welded together so as to achieve said combination, one-piece, integral electrical connector-power switch module.

13. The module as set forth in claim 12, wherein:

said electrical connector housing comprises a front wall and a rear wall; and said power switch housing comprises a rear wall and a vertically dependent barrier wall for engaging said front wall of said electrical connector housing when said power switch housing is disposed atop said electrical connector housing so as to render said rear walls of said power switch housing and said electrical connector housing positionally aligned with respect to each other when said electrical connector housing and said power switch housing are ultrasonically welded together.

14. A combination electrical connector-power switch module, comprising:

an electrical connector comprising a thermoplastic housing having a plurality of electrical terminals mounted within said housing for connection to electrical circuits; and a power switch comprising a thermoplastic housing having a plurality of electrical terminals, a switch mechanism mounted therein for controlling electrical power to said plurality of electrical terminals of said electrical connector through the electrical circuits, and a recess defined within a lower portion of said power switch housing for accommodating an upper portion of said electrical connector housing, wherein said lower portion of said power switch housing is mounted upon said upper portion of said electrical connector housing and ultrasonically welded to said upper portion of said electrical connector housing, whereby a combination, one-piece, integral electrical connector-power switch module is formed.

15. The module as set forth in claim 14, wherein:

said plurality of electrical terminals of said electrical connector comprise terminals bent at a 90° angle wherein one end of each one of said plurality of electrical terminals of said electrical connector is insertable through an aperture defined within a printed circuit board (PCB) having electrical circuits defined thereon.

16. The module as set forth in claim 15, wherein:

said plurality of electrical terminals of said power switch housing comprise terminals bent at a 90° angle wherein one end of each one of said plurality of electrical terminals of said power switch housing is insertable through an aperture defined within the printed circuit board (PCB) having the electrical circuits defined thereon so as to provide electrical power to the electrical circuits of the printed circuit board (PCB) and said plurality of electrical terminals of said electrical connector.

17. The module as set forth in claim 16, wherein:

each one of said plurality of electrical terminals of said power switch housing have crimped, flattened portions defined adjacent to said one end of said each one of said plurality of electrical terminals so as to limit the depth to which said one end of said each one of said plurality of electrical terminals of said power switch housing can be inserted into the apertures of the printed circuit board (PCB).

18. The module as set forth in claim 16, wherein:

a second end of a first one of said plurality of electrical terminals of said power switch housing defines a common electrical contact, a second end of a second one of said plurality of electrical terminals of said power switch housing defines a make/break contact; and said switch mechanism comprises a contactor having a first portion always in contact with said common electrical contact, and a second portion movable between a first position at which said second portion is engaged with said make/break contact so as to define an ON state for said power switch, and a second position at which said second portion is disengaged from said make/break contact so as to define a STANDBY state for said power switch; and an actuator for moving said contactor between said first and second positions.

19. The module as set forth in claim 18, wherein:

said contactor comprises a substantially U-shaped hairpin type contactor comprising first and second leg members.

20. The module as set forth in claim 19, wherein:

said first leg member of said contactor has said first portion of said contactor defined therein as a recessed portion disposed around said common electrical contact so as to define therewith a first pivotal axis around which said contactor is pivotally movable between said first and second positions; and said actuator comprises a rocker-type actuator pivotally movable around a second pivotal axis for movement between first and second positions and engaged with said second leg member of said contactor for movably actuating said contactor between said first and second positions of said contactor when said actuator is moved between said first and second positions of said actuator.

21. The module as set forth in claim 20, wherein:

said first and second pivotal axes of said contactor and said rocker-type actuator are offset with respect to each other so as to bias said contactor toward said ON state.

22. The module as set forth in claim 18, wherein:

said power switch housing comprises substantially C-shaped clamping members for clampingly engaging portions of said plurality of electrical terminals of said power switch housing intermediate said first and second ends of said electrical terminals of said power switch housing.

23. The module as set forth in claim 18, wherein:

said power switch housing comprises a pair of oppositely disposed sidewalls having a pair of apertures defined within each one of said pair of oppositely disposed sidewalls wherein each one of said pair of apertures defined within one of said pair of oppositely disposed sidewalls is coaxially aligned with one of said pair of apertures defined within the other one of said pair of oppositely disposed sidewalls; and said common electrical contact and said make/break contact extend transversely across said power switch housing between said pair of oppositely disposed sidewalls wherein said second end of said first one of said plurality of electrical terminals defining said common electrical contact enters a first one of said apertures defined within a first one of said pair of oppositely disposed sidewalls and exits through a first one of said apertures, coaxially aligned with said first one of said apertures, defined within a second one of said pair of oppositely disposed sidewalls, and said second end of said second one of said plurality of electrical terminals defining said make/break contact enters a second one of said apertures defined within said second one of said pair of oppositely disposed sidewalls and exits through a second one of said apertures, coaxially aligned with said second one of said apertures, defined within said first one of said pair of oppositely disposed sidewalls.

24. The module as set forth in claim 15, wherein:

said electrical connector housing comprises detent means for snap-fitting engagement within apertures defined within the printed circuit board (PCB) so as to fixedly mount said electrical connector upon the printed circuit board (PCB).

25. The module as set forth in claim 14, wherein:

said electrical connector housing comprises a front wall and a rear wall; and said power switch housing comprises a rear wall and a vertically dependent barrier wall for engaging said front wall of said electrical connector housing when said power switch housing is disposed atop said electrical connector housing so as to render said rear walls of said power switch housing and said electrical connector housing positionally aligned with respect to each other when said electrical connector housing and said power switch housing are ultrasonically welded together.

* * * * *